United States Patent [19]

Crowe

[11] 3,970,338

[45] July 20, 1976

[54] METHOD OF MAKING REVERSIBLE HOOKED ARTICLES

[75] Inventor: Lloyd L. Crowe, Milwaukee, Wis.

[73] Assignee: Shirley L. Depke, Milwaukee, Wis.

[22] Filed: June 2, 1975

[21] Appl. No.: 583,088

[52] U.S. Cl. ..... 289/1.5; 28/15

[51] Int. Cl.[2] ..... B65H 69/04

[58] Field of Search ..... 28/15; 289/1.2, 1.5, 289/17, 18; 112/80, 410, 411

[56] References Cited

UNITED STATES PATENTS

| | | | |
|---|---|---|---|
| 2,575,470 | 11/1951 | Salz | 28/15 |
| 3,098,280 | 7/1963 | Harris et al. | 28/15 |
| 3,415,558 | 12/1968 | Holzknecht | 289/1.5 |
| 3,621,541 | 11/1971 | Watkins | 28/15 |
| 3,857,592 | 12/1974 | Koike | 289/17 |

*Primary Examiner*—Louis K. Rimrodt
*Attorney, Agent, or Firm*—Joseph P. House, Jr.

[57] ABSTRACT

Looped tufts of yarn are drawn through proximate openings in a foundation fabric from opposite sides of the fabric and are intertwined in pairs to form square knots that secure opposed tufts of yarn to each other and to the fabric strands separating the proximate openings. The free ends of each pair of knotted yarn tufts extend in opposite directions from opposite sides of the foundation fabric. Such knotted yarn tufts cover both sides of the foundation fabric and form piles on both sides thereof. Different colored yarn tufts may be used and may be arranged to form predetermined decorative patterns on both sides of the article. The patterns on opposite sides of the article can be the same or they can be entirely different.

13 Claims, 13 Drawing Figures

METHOD OF MAKING REVERSIBLE HOOKED ARTICLES

BACKGROUND OF THE INVENTION

In the past, hooked articles such as rugs, wall hangings, chair seats, and the like have been made by tying tufts of yarn to one side of a foundation fabric, the free ends of the yarn tufts extending away from the foundation fabric and forming a pile on one side thereof. Different colored yarn tufts were used and were arranged in predetermined patterns to form a decorative surface on the pile side of the article, the other side being rough and being normally hidden from view.

SUMMARY OF THE INVENTION

This invention provides a novel method of making hooked articles which have piles with finished decorative surfaces on both sides of the foundation fabric. One looped tuft of yarn is pulled part way through an opening in the foundation fabric from one side thereof. A second looped tuft of yarn is pulled part way through a proximate opening in the foundation fabric from the other side thereof, the second yarn tuft passing through the loop of the first yarn tuft. The free ends of the first tuft are pulled through the loop of the second tuft to form a square knot securing the two tufts to each other and to the foundation fabric strands separating the proximate openings. This process is repeated over and over until the foundation fabric is covered on both sides by piles formed by the free ends of yarn tufts. Different colored yarn tufts at opposite sides of the foundation fabric may be knotted together and may be arranged in predetermined decorative patterns on both sides of the foundation fabric. The patterns on opposite sides of the article can be the same or they can be entirely different.

In the preferred technique, the operator carries a hook in each hand and faces the edge of a frame upon which the foundation fabric is stretched. The yarn tufts are drawn through the fabric by the hook at the opposite side thereof. The operator does not lay the hooks down, but transfers the hook in his hand between a projecting hooking position and a retracted palming position in which the hook is out of the way while the operator uses his thumb and forefinger for manipulating the yarn.

Other objects, features and advantages of the invention will appear from the disclosure hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
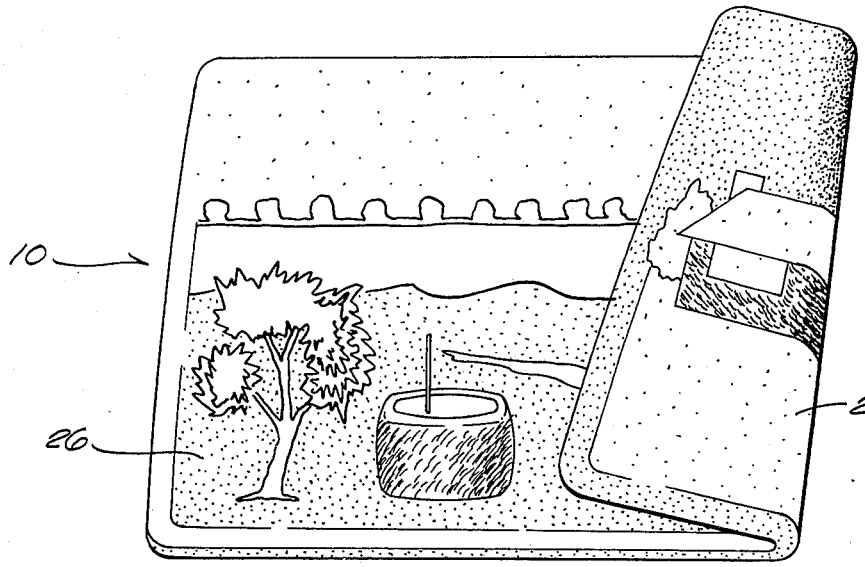
FIG. 1 is a perspective view of a hooked rug made in accordance with the method of this invention and having different patterns on opposite sides of the rug, the rug being turned back to show finished pile surfaces on both sides.
Figure 3:
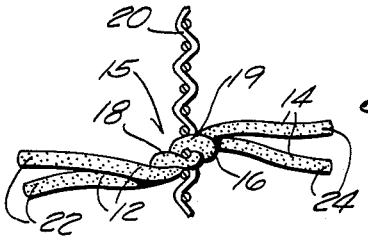
FIG. 3 is a cross-sectional view of a portion of the foundation fabric showing a pair of looped tufts of yarn secured thereto by a square knot in accordance with the method of this invention. This view is taken along the line 3—3 of FIG. 2.

FIG. 1 shows a reversible hooked rug 10 having finished piles on both sides thereof with a different pattern on one side than on the other. This is one end product of the method of this invention. FIG. 3 shows a pair of looped yarn tufts 12 and 14 which are knotted at their inner looped ends 16 and 18 to each other and to a strand 19 of foundation fabric 20. Foundation fabric 20 comprises a mesh of interwoven crossed strands having openings between adjacent cross strands.

The free ends 22 and 24 of yarn tufts 12 and 14 extend outwardly in opposite directions from opposite sides of foundation fabric 20. The hooked rug 10 is made up of thousands of pairs of knotted yarn tufts 12 and 14 arranged adjacent to each other to form finished piles of yarn ends on both sides of the foundation fabric 20. The decorative patterns 26 and 28 (FIG. 1) on rug 10 may be formed from different colored yarn tufts arranged in predetermined patterns. The patterns 26 and 28 can be the same (one the mirror image of the other) or they can be entirely different.

Figure 2:
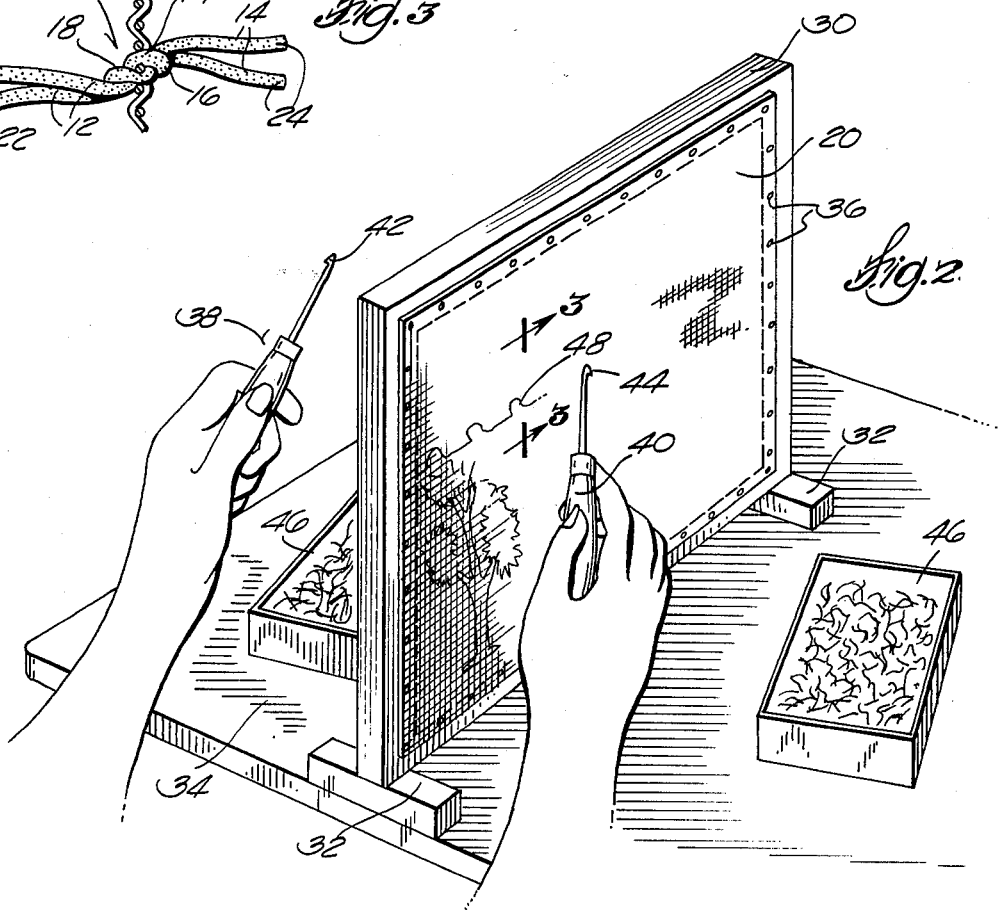
FIG. 2 is a perspective view of a frame supporting a foundation fabric, and two hand-held hooks used in the method of this invention.

The method of this invention is typically performed manually. The foundation fabric 20 is supported in a vertical plane in front of the person performing the method by a suitable support such as a rectangular wooden frame 30 (FIG. 2) with supporting legs 32 sitting on a table 34. The person sits at the table and faces the edge of the frame 30. Foundation fabric 20 is supported on frame 30 by thumb tacks 36. A pair of hand-held hooks 38 and 40 which are small enough on their hooked ends 42 and 44 to pass through the openings in foundation fabric 20 are used in the manual method, the hooks 38 and 40 being hand-held at opposite sides of foundation fabric 20. Containers 46 full of precut yarn tufts of various colors are placed on both sides of frame 30.

Figure 4:
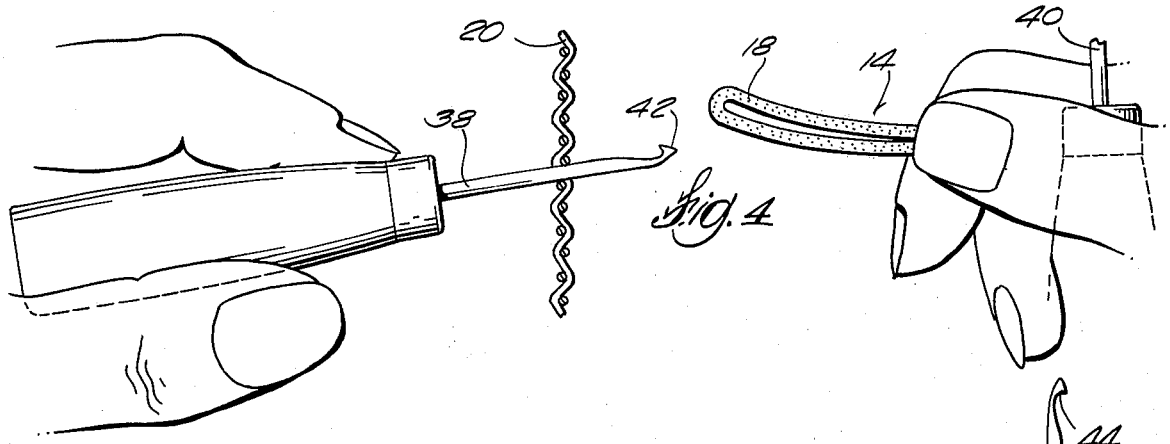
FIGS. 4 through 13 show the successive steps involved in manually knotting a pair of looped yarn tufts to a foundation fabric in the course of making a reversible hooked article in accordance with this invention.
Figure 5:
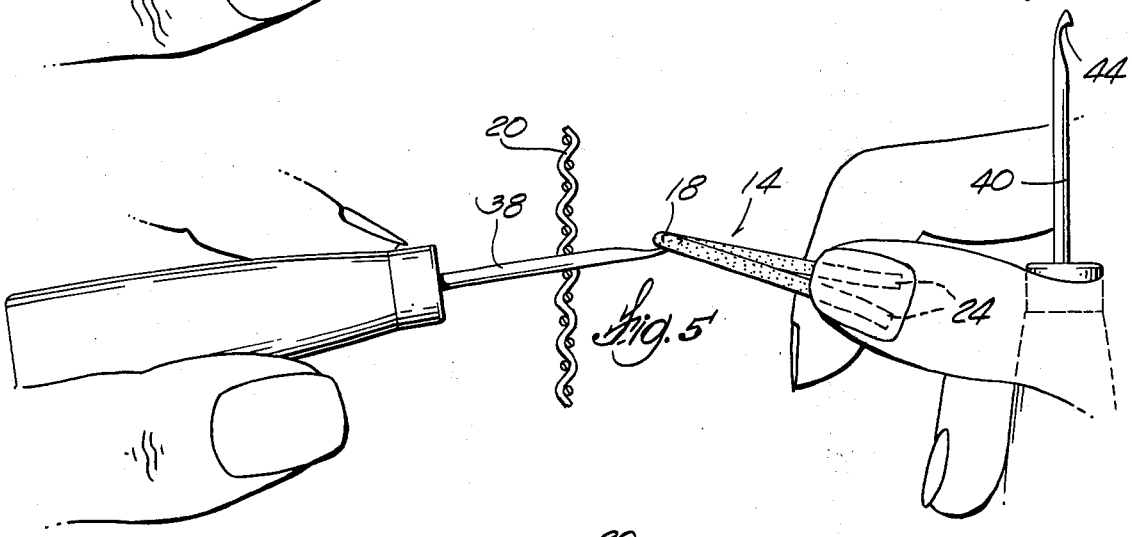
Figure 6:
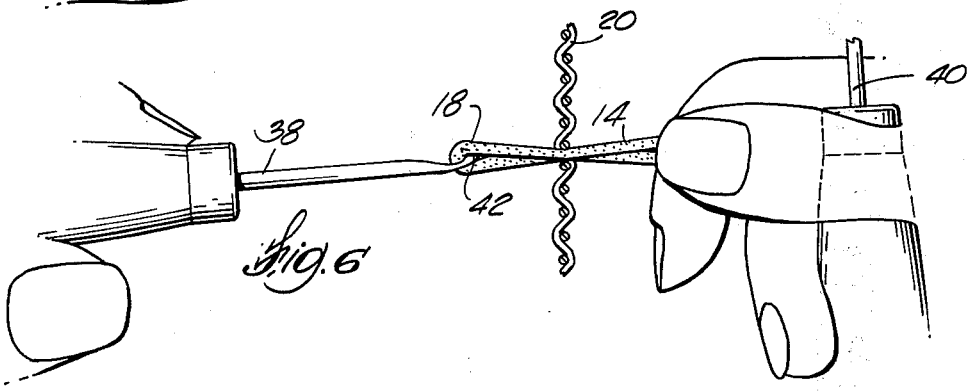
Figure 7:
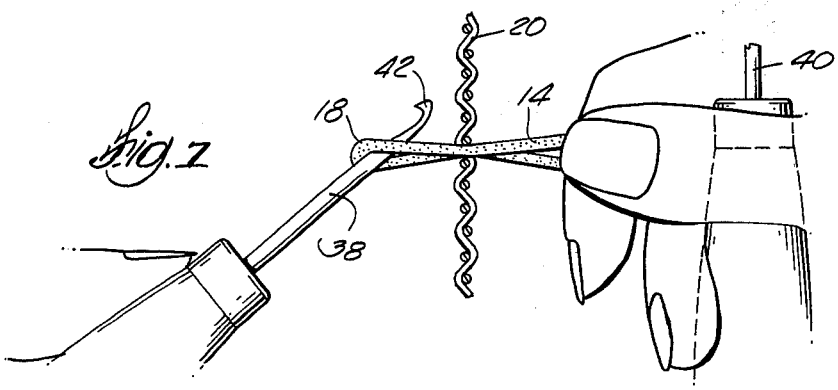

The method begins by thrusting one of the hooks 38, 40 through an opening in foundation fabric 20 as shown in FIG. 4. Either of the hooks 38, 40 can be thrust through fabric 20 first. After the hook is thrust through fabric 20, a yarn tuft 14 is picked up from container 46 between the thumb and forefinger of the operator's free hand and is folded over to form a looped end 18, which is then manually engaged with hooked end 42 of hook 38 as shown in FIGS. 5. During this manipulation, hook 40 is retracted or palmed and is held in an out-of-the-way position by the middle, ring and little fingers. The free ends 24 of tuft 14 are desirably of even length, as indicated in FIG. 5. The loop 18 is then drawn by hook 38 part way back through the opening in fabric 20 as shown in FIG. 6. The hooked end 42 of hook 38 is then disengaged from loop 18 as shown in FIGS. 7 and 8 and is subsequently palmed as shown in FIG. 9.

Figure 8:
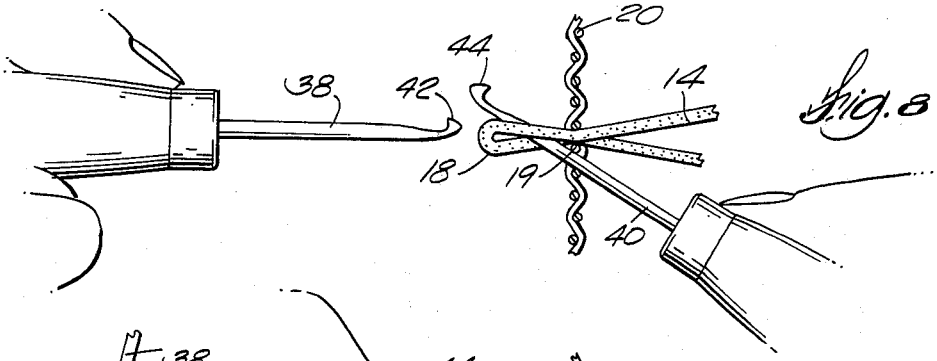

Next, the hook 40 in the other hand is thrust through a proximate opening on the other side of fabric 20 (FIG. 8) in such manner that the hooked end 44 passes through loop 18 as shown in FIG. 8. This is important because the opposing yarn tuft must ultimately pass through loop 18 to form the square knot. The word "proximate" is used herein to indicate a neighboring opening which can be the next adjacent opening but is not necessarily the next adjacent opening. The distance between the two openings can vary, depending on the desired density of the pile. In all cases, however, the two openings employed will be separated by one or more strands of the foundation fabric 20 such as strand 19 in FIG. 8.

Figure 9:
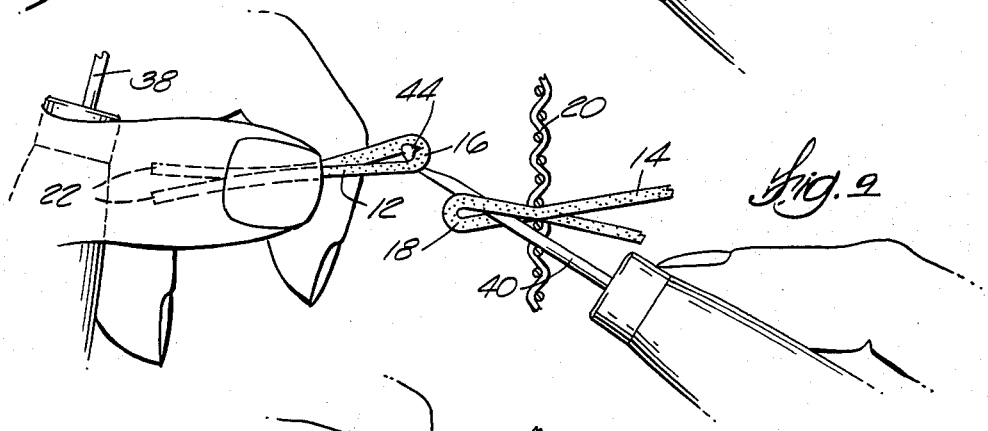
Figure 10:
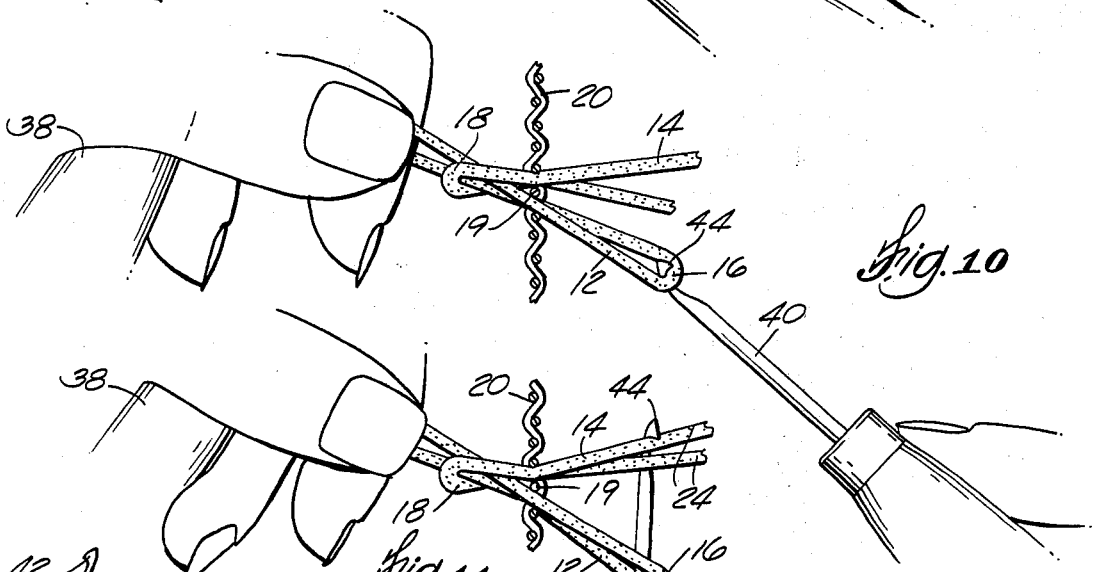
Figure 11:
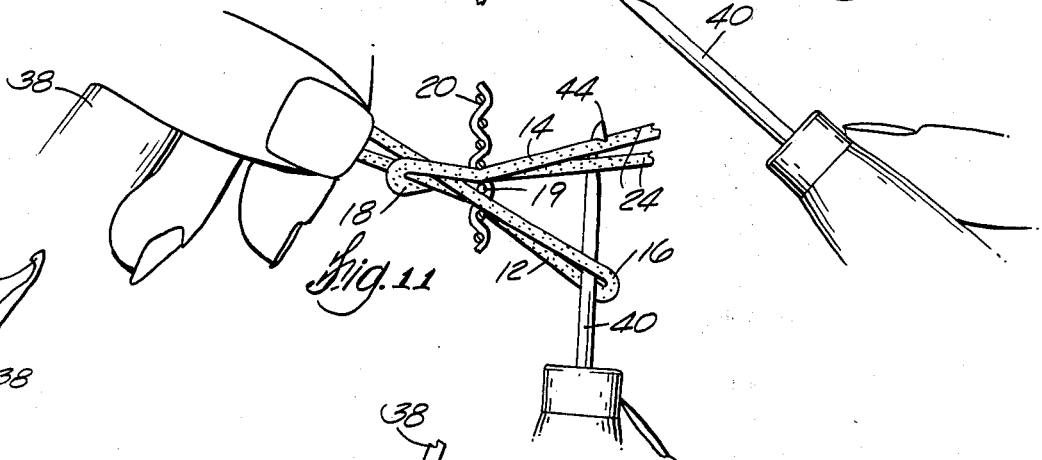
Figure 12:
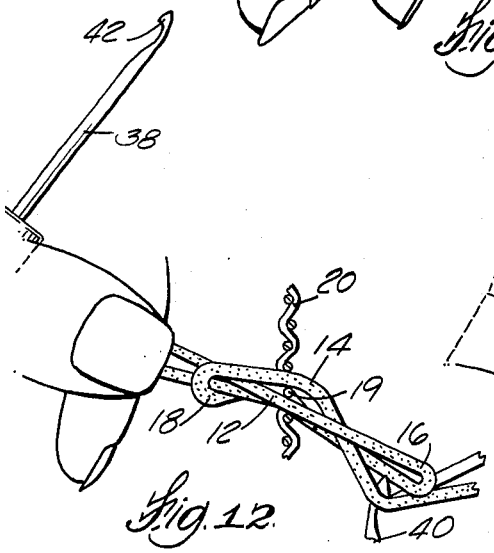
Figure 13:
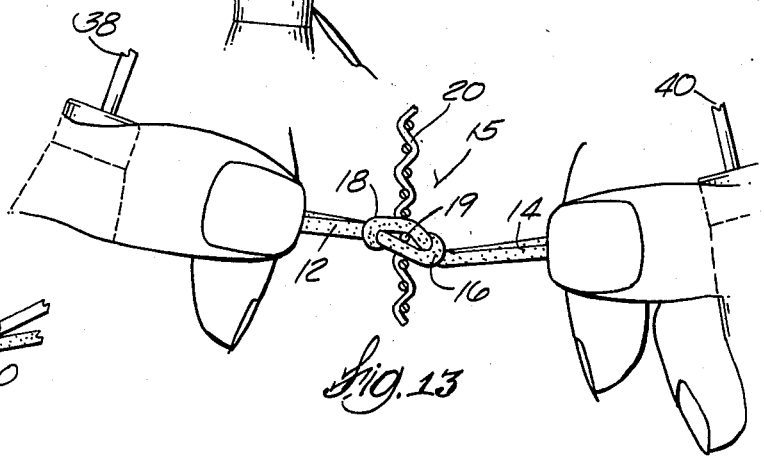

Next, the second tuft of yarn 12 is picked up between the thumb and forefinger of the free hand and is looped at 16, the loop 16 being manually engaged on the end 44 of hook 40 (FIG. 9). The yarn tuft 12 is then drawn part way through loop 18 of tuft 14 and through loop 18 of tuft 14 and through the second fabric opening as shown in FIG. 10. Hooked end 14 is then advanced through loop 16 and is engaged with the free ends 24 of the first loop 14. The free ends 24 are then drawn through loop 16 as shown in FIG. 12. This intertwines the yarn tufts 12 and 14 in such a way as to make a square knot 15 therebetween. Finally, the oppositely extending free ends 22 and 24 of yarn tufts 12 and 14 are grasped between the thumb and forefinger of the operator's respective hands and are pulled away from each other to draw the square knot 15 taut around strand 19 as shown in FIG. 13. Note from FIG. 13 that the operator retains both hooks 38, 40 in retracted or palmed position. Knot 15 is tightened by pulling the tufts 12, 14 against each other. Accordingly, little or no strain is imposed on strand 19 of the foundation fabric. This feature avoids possible breakage or warping of the foundation fabric.

The foregoing process is repeated over and over until both sides of foundation fabric 20 are covered by piles made up of the free ends 22 and 24 of the yarn tufts 12 and 14. Various color yarn tufts are used and are arranged on both sides in predetermined patterns to form decorative surfaces on both sides of the article. A guide for the patterns is normally drawn or otherwise marked on both sides of foundation fabric 20, such as shown at 48 in FIG. 2. The patterns on the opposite sides of foundation fabric 20 can be the same or they can be entirely different. Neither pattern is visible through the other under normal circumstances. If desired, the same patterns can be used on both sides, with the same or different colors on the two sides. With the same pattern on both sides, the pattern guide need only be marked on one side of foundation fabric 20.

To make the same patterns in different colors on opposite sides of the article, each tuft of one color yarn on one side of the article is knotted to a tuft of another color yarn on the other side of the article.

I claim:

1. A method of making reversible hooked articles on a base comprising a foundation fabric having crossed strands with openings between adjacent crossed strands, comprising the steps of:

a. pulling a first looped tuft of yarn part way through one of said openings from one side of said foundation fabric;

b. pulling a second looped tuft of yarn part way through a proximate opening from the other side of said foundation fabric, the second yarn tuft passing through the loop of the first yarn tuft;

c. pulling the free ends of one yarn tuft through the loop of the other yarn tuft to form a square knot securing said yarn tufts to each other and to the foundation fabric strands separating said proximate openings;

d. tightening said square knot; and e. repeating steps (a) through (d) over successive proximate openings in said foundation fabric to cover both surfaces of said fabric with symetrically disposed tufts to form piles on both sides of said foundation fabric.

2. The method of claim 1 wherein looped tufts of different colored yarn are utilized to form said reversible hooked article, the different colored tufts being spatially arranged on both surfaces of said foundation fabric to form predetermined colored patterns on both surfaces of said reversible tufted sheet material.

3. The method of claim 2 wherein the colored pattern on one surface of said reversible hooked article is different from the colored pattern on the other surface thereof.

4. The method of claim 2 wherein guide lines are marked on at least one surface of said foundation fabric to serve as a guide for the spatial arrangement of said tufts of different colored yarn.

5. The method of claim 4 wherein guide lines are marked on both surfaces of said foundation fabric and wherein the pattern of guide lines on one surface of said foundation fabric differs from the pattern of guide lines on the other surface thereof.

6. The method of claim 2 wherein each tuft of one color yarn on one side of the article is knotted to a tuft of another color yarn on the other side of the article to form patterns on the opposite surfaces of said article which are identical in form.

7. The method of claim 1 wherein one looped tuft of yarn is manually pulled part way through said opening by a hook held in one hand and the other looped tuft of yarn is manually pulled part way through said proximate opening by a hook held in the other hand.

8. The method of claim 7 wherein the free ends of one looped tuft are manually pulled through the loop of the other looped tuft by a hook held in one hand and extended through said loop.

9. The method of claim 1 and further comprising the step of simultaneously manually tugging on the free ends of said two looped tufts to tighten said square knot.

10. The method of claim 1 wherein said proximate opening is adjacent to the first-mentioned opening.

11. A method of making reversible hooked articles on a mesh base comprising the steps of:

a. mounting the mesh base on a frame;

b. positioning the frame in edge relation to an operator so that the operator faces the edge of the frame with one hand at each side of the mesh base;

c. disposing hooks in each hand of the operator;

d. using said hooks sequentially to draw looped tufts of yarn from opposite sides of the mesh base through proximate openings in said mesh base;

e. shifting said hooks in the operator's hand between a projecting hooking position and a retracted palmed position in which the operator's thumb and forefinger are free to manipulate the yarn, without laying down the hooks; and f. knotting the looped ends of the tufts together about a strand of the mesh base.

12. The method of claim 11 in which step (d) includes drawing one tuft through the looped end of the other tuft.

13. The method of claim 12 in which step (f) includes drawing the free ends of one tuft through the looped end of the other tuft.

* * * * *